United States Patent [19]

Schwartz et al.

[11] Patent Number: 4,610,496

[45] Date of Patent: Sep. 9, 1986

[54] CONNECTOR MECHANICAL INTERLOCK USING BALL DETENTS

[75] Inventors: Lawrence Schwartz, Huntington Beach; Jan A. Kilsdonk, Corona; Jerry T. Steele, Fountain Valley, all of Calif.

[73] Assignee: Flight Connector Corporation, Rancho Dominguez, Calif.

[21] Appl. No.: 737,673

[22] Filed: May 24, 1985

[51] Int. Cl.[4] ..... H01R 13/631

[52] U.S. Cl. ..... 339/91 B; 339/91 R

[58] Field of Search ..... 339/91 R, 91 B; 285/317

[56] References Cited

U.S. PATENT DOCUMENTS

| | | | |
|---|---|---|---|
| 2,178,337 | 10/1939 | Douglas | 339/91 B |
| 2,771,308 | 11/1956 | Vitcha et al. | 285/317 |
| 3,237,147 | 2/1966 | Elliott | 339/91 B |
| 4,420,209 | 12/1983 | Reis et al. | 339/91 R |

*Primary Examiner*—John McQuade
*Attorney, Agent, or Firm*—Irving Keschner

[57] ABSTRACT

A mechanical interlock system using ball detents for interlocking the first and second connector halves of an electrical connector assembly. In the preferred embodiment, two ball detents are utilized. The first connector half, or plug member, has recesses for receiving ball detents secured in the second connector half, or receptacle member. Slots are formed in each of the side walls of the receptacle member, each ball detent being positioned in an aperture formed between the slot and a receiving area in the receptacle member. A first portion of the surface of the ball detent extends into the slot and a second portion of the ball surface extends into the receiving area, the ball detents being secured in the aperture by a preloaded spring washer positioned in each slot. The second surface portion of each ball detent enters the recesses when the plug is inserted into the receptacle area thus forming the mechanical interlock.

6 Claims, 4 Drawing Figures

CONNECTOR MECHANICAL INTERLOCK USING BALL DETENTS

BACKGROUND OF THE INVENTION

1. Field of the Invention

The present invention provides an improved connector mechanical interlock utilizing ball detents which are maintained in position and compression loaded by a spring washer.

2. Description of the Prior Art

Electrical connectors having means for preventing inadvertent decoupling of the connector parts have been available in the prior art for many years. One form of conventional electrical connector used in the prior art includes a plug and receptacle, each of which contains an insulating material carrying a plurality of engagable contacts therein, whereby when the plug and receptacle are fully mated, the contacts are engaged to complete electrical circuits therebetween. A bayonette type connector coupling mechanism is frequently employed to positively retain the plug and receptacle of the connector in the fully mated position. The coupling mechanism may also include further means such as a spring to help in the retention of the plug and receptacle in the fully mated orientation.

Another form of connector device is of the type wherein a rotatable coupling nut is not required to insure coupling of the two connector parts. In this case, interlocking means are required which will insure a sufficient mechanical interlock betwen the plug and receptacle components of the electrical connector. In many of these connector types, ball detents are utilized to provide the mechanical interlock. In general, the detents are positioned on the receptacle portion of the electrical connector and engage recesses formed on the plug member when the plug member is inserted into the receptacle. Various means are utilized to provide a compressive force on the ball detents in a manner to allow the ball to first be forced in a direction away from the plug as it is being inserted into the receptacle and then forced back toward the recesses in the plug to form the mechanical interlock. However, the prior art ball detent mechanical interlock systems generally are inefficient and tend to fail relatively rapidly due to the uneven compression applied to the ball detents and the fact that the ball detents can easily become misaligned with the recesses due to the repeated insertion of the plug into the receptacle member.

What would be desired is to provide an improved mechanical interlock system which utilizes ball detents which are loaded in a manner such that the balls are maintained in a substantially fixed alignment and wherein a substantially uniform force is applied thereto by a relatively simple loading device, the overall mechanical interlock system thus being relatively inexpensive, reliable and having a relatively long lifetime.

SUMMARY OF THE PRESENT INVENTION

The present invention provides a mechanical interlock system using ball detents for interlocking the first and second connector halves of an electrical connector assembly. The first connector half, or plug member, has recesses for receiving the ball detents secured in the second connector half, or receptacle member. Slots are formed in each of the sidewalls of the receptacle member, a ball detent being positioned in each of the apertures formed between the slot and a receiving area in the receptacle member. It should be noted that the term "slot(s)" has been used to describe the receiving area for another part to nest therein. A first portion of the surface of the ball extends into the slot and a second portion of the ball surface extending into the receptacle receiving area. The ball is maintained in the aperture by a preloaded apertured spring washer positioned in the slot in a manner whereby the ball surface partially extends into the washer aperture. The second portion of each ball surface engages the recesses when the plug is inserted in the receptacle receiving area thus forming the mechanical interlock.

The ball detent lock thus formed is spring loaded and the compressive force applied to the ball can be varied depending upon the spring washer selected and also on the dimensions of the slot. The compressive force applied to each detent ball is substantially uniform. The spring loaded washer in essence performs two functions, i.e., maintaining the ball detent in proper alignment with the slot aperture and thus with the corresponding recess formed on the plug member and also providing the appropriate compressive force on the ball to provide the interlock feature. The system of the present invention provides significant advantages over the prior art in that a minimum of parts are required thus increasing reliability while reducing system cost. In addition, a portion of the mechanical interlock system is formed during and as a part of the fabrication of a conventional receptacle member, further reducing the cost of the system.

BRIEF DESCRIPTION OF THE DRAWING

For a better understanding of the invention as well as other objects and further features thereof, reference is made to the following description which is to be read in conjunction with the accompanying drawing wherein.

DETAILED DESCRIPTION OF THE INVENTION

Figure 1:
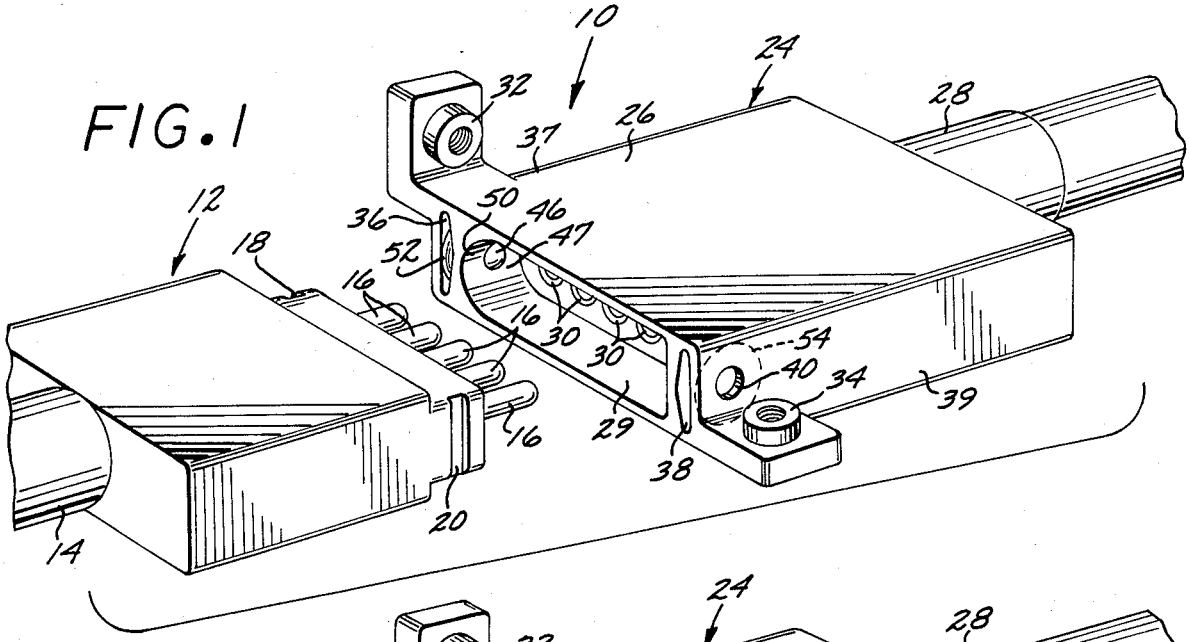
FIG. 1 is a perspective view of a first electrical connector member having recesses formed thereon and an adjacent second electrical connector member prior to mating.
Figure 2:
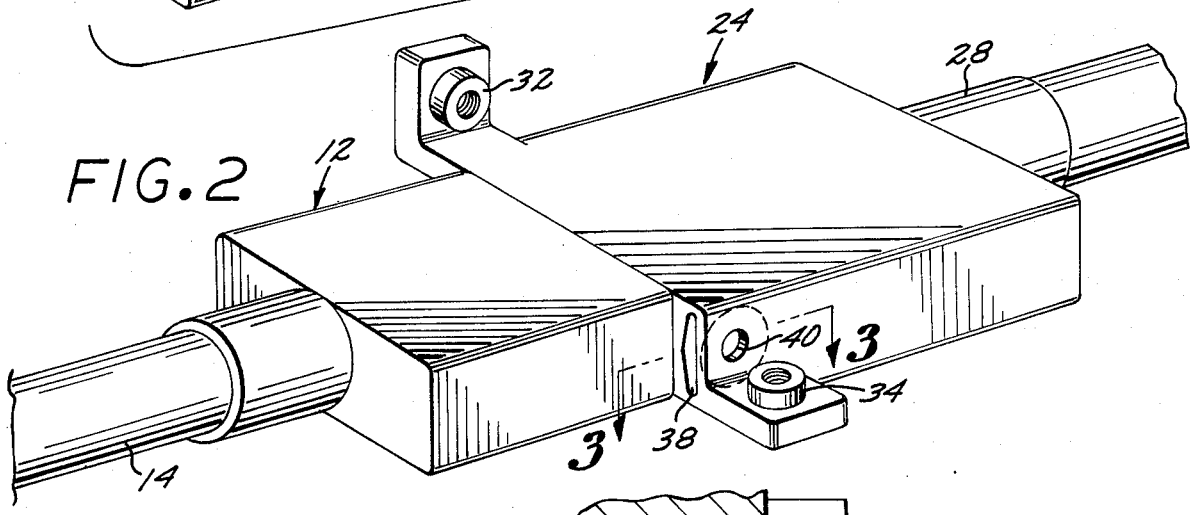
FIG. 2 illustrates a perspective view of the first electrical connector member mated to the second electrical connector member.

Referring now to FIG. 1, a perspective view of the connector assembly 10 of the present invention as illustrated in its unmated condition. In particular, the connector assembly 10 comprises a first connector half, or plug member, 12 having a cable 14 connected thereto and a plurality of pin contacts 16. A pair of grooves or recesses 18 and 20 are formed on the edges of the engaging portion 22 of the plug 12. The mating second electrical connector half, or receptacle 24, comprises a housing 26 a cable 28 connected to the housing 26 and a receiving area or opening, 29 for receiving portion 22 of plug 12. A plurality of socket contacts 30 are incorporated within the housing 24, each pin contact 16 being inserted into corresponding socket contacts 30 when connector halves 12 and 24 are in the mated condition as shown in FIG. 2. A pair of self locking clinch nuts 32 and 34 are provided to allow for the electrical connector assembly 10 to be mounted to an appropriate mounting object. A pair of slots, or channels, 36 and 38 shaped in the form of a chevron are formed in the sidewalls 37 and 39, respectively, of housing 24 as illustrated. A hole is formed in the outer surfaces of sidewalls 37 and 39 (only hole 40 illustrated) to receive a ball detent during the mechanical interlock system fabrication process described hereinafter. The sidewall holes and slots 36 and 38 are formed in the connector part 24 during the fabrication and casting process thereof. One of the detent balls 46 is illustrated as projecting from an aperture 47 formed between slot 36 and area 29. A spring loaded washer member 52 is positioned within slot 36. The operation of the spring loaded washer 52, detent ball 46, spring washer 54 (illustrated in phantom) and the ball detent associated with the washer 54 (not illustrated) will be described in more detail hereinafter with reference to FIGS. 3 and 4.

In the preferred mode, the housing materials for the receptacle 24 and the plug 12 are made from a zinc die cast electrically deposited nickel. Referring to FIG. 4, slot 38 is cut, or machined, in sidwall 39 of receptacle 24, reference numerals 60 and 62 representing the inner and outer walls, respectively, formed when slot 38 is cut into sidewall 39. Aperture 40, formed in wall 62 is large enough such that a detent ball 64 can be inserted therethrough and come to rest in tapered hole 65 formed in inner wall 60. Typically the detent ball 64 has a diameter of 0.060", hole 40 have a slightly larger diameter than that of the ball. The tapered end of the hole 65 is such that the diameter of the lower hole is approximately 0.050" such that approximately 2/5 of the ball 64 will pass through. After the ball 64 is inserted in hole 65, a curved spring washer 80 is inserted into the slot 38 and pushed in the direction of arrow 82 in a manner such that the aperture 84 in washer 80 engages the surface of the ball 85 extending into the slot 38 as is shown more clearly in FIG. 3. In essence, the spring washer member 80 provides a dual function; the washer member holds the ball detent 64 within the slot 38 such that it will align itself with the corresponding recess 20 formed on plug 12 and the washer applies a compressive (spring) force on the ball detent. A curved washer has certain characteristics that make it the preferred washer to be utilized. It is understood that the aperture 84 in the washer is smaller than the diameter of the ball such that when the washer is inserted into the slot 38 the washer deflects and the ball detent pops partially into the aperture 84, the ball detent and washer thus being held within the slot 38. In essence, an interlock system is provided which is not fixed but is spring loaded and provides a spring loaded ball detent with a constant compressive force applied to the ball. The mechanism, as set forth hereinabove, is relatively inexpensive. All that is required is a standard ball bearing and a spring washer which is always under slight compressive force. The design of the slot 38 is not critical; the chevron shape was selected as shown since it more easily accommodates curved washers. A preloaded spring washer is necessary, the free height of the slot "a" determining the amount of preload applied to the washer 80, the length "b" of the slot 38 determining the overall size of the washer 80. Length "b" is typically equal to the depth of receiving area 29. The curved washers are preferred to be round since it provides a chamfered surface (radius) which makes it go easier over the surface of the ball detent and to deflect the ball surface then popping into aperture 84. The washer can also be a curved beam (rectangular shape), for example the shape not being important as long as the spring sets the proper compressive force on the ball detent 64. It should be noted that the washer may have a dimple (nest) instead of an aperture and arranged in a manner such that the dimple holds the ball detent in position. Other types of springs, such as a wave spring, can be utilized. Examples of such springs and the design technique utilized to design a spring to provide a desired compressive force is shown, for example, in Design Handbook, Springs, Custom Metal Parts, published by the Associated Spring Corporation, Bristol, Conn. in 1970.

Figure 3:
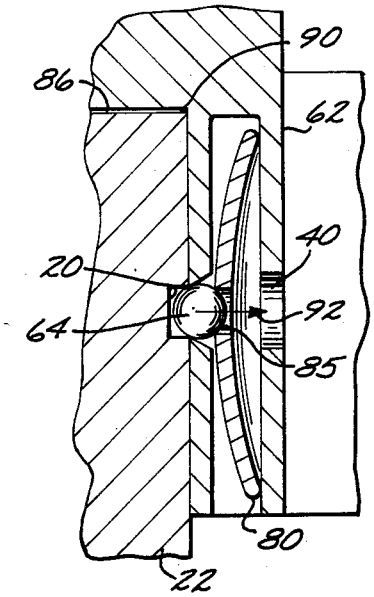
FIG. 3 is a cross-sectional view along line 3—3 of FIG. 2.
Figure 4:
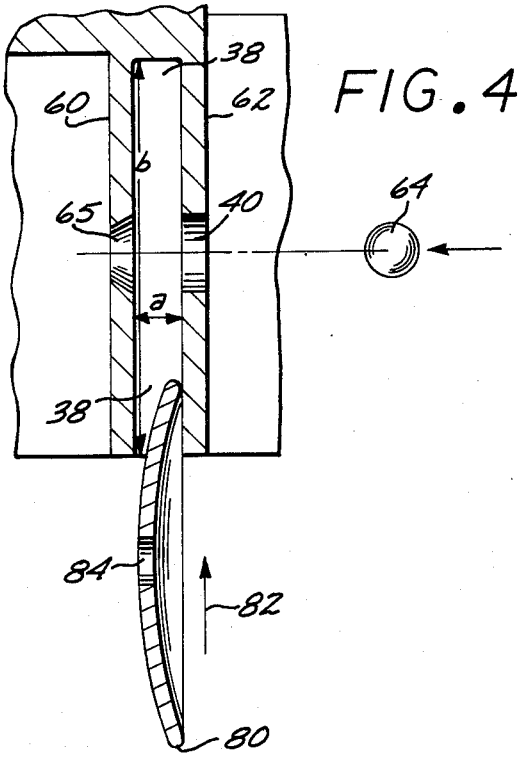
FIG. 4 illustrates how each ball detent is positioned and secured within the second electrical connector member.

FIG. 3 is a cross-section along line 3—3 of FIG. 2 and illustrates how the mechanical interlock system of the present invention works. In particular, as the front portion 22 of the plug 12 is inserted into the receptacle 24, the front surface 86 thereof engages the surface of the ball 64 positioned to extend from the slot and into the receiving area 29 in the receptacle 24. The ball is essentially forced in the direction of arrow 92 by portion 22 of the plug 12 it being the characteristic of the curved washer 80 to deflect in a manner to allow the ball 64 to move in the direction of arrow 92. However, at this time, the ball is still under compressive force by the spring 80 and when the portion 22 is in the mated condition (as shown in FIG. 3), recess 20 is substantially opposite the position of ball 64. The compressive force of the spring 80 is such to force the ball 64 into the recess 20 thus providing the mechanical interlock as described hereinabove. It should be noted that the ball detent/recess interlock interaction occurs simultaneously in slot 36, the interlock system being illustrated only for slot 38 for the purposes of simplicity. It should also be noted that the mechanical interlock system of the present invention can also operate with one ball detent/recess combination.

As shown in FIG. 3, the washer 80 in its curved position almost extends the entire length of slot 38 and in its curved position almost extends the entire free height of the slot 38. In any event, the slot is designed such that it plays a determining factor in designing the washer to provide a particular compressive force on the ball 64. As noted hereinabove, the design handbook provides techniques for designing a curved washer with the desired compressive force. An additional design factor is that the connectors may have to be designed to break away at a specific pressure, such as 15 pounds plus or minus 5 pounds, to allow the mechanical interlock to be broken when necessary.

The system as described hereinabove thus provides a relatively simplified and inexpensive technique for providing a mechanical interlock between two connector halves when the halves are in a fully mated condition. The spring washer as noted hereinabove provides a dual function, i.e., it maintains the ball in the proper position in the receptacle housing such that can align with the recesses on the plug and provides the necessary compressive force on the ball detent to allow the ball to enter the recess formed on the plug member to provide the mechanical interlock required. The slots in the receptacle and the ball detent receiving can be formed during the fabrication process while the receptacle is formed and thus the additional cost to modify the receptacle is relatively low. In a similar manner, the ball bearing used as the ball detent and the curved washer which provides the two functions mentioned hereinabove are also relatively inexpensive and as the overall mechanical interlock system as described is inexpensive and requires only a few mechanical parts, making the mechanical interlock system more reliable than those available in the prior art.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A mechanical interlock system using a ball detent for interlocking the first and second connector halves of an electrical connector assembly comprising:

a detent receiving means formed on the front portion of said first connector half, said second connector half comprising a first elongated sidewall;

a first elongated recess of predetermined dimensions formed in said first side wall of said second connector half, said elongated recess dividing said first side wall into first and second wall portions, said second connector half having an opening to receive the front portion of said first connector half, an aperture being formed in said first wall portion, said aperture connecting said opening and said elongated recess;

a ball detent positioned in said aperture, a first portion of the surface of said ball detent extending partially into said elongated recess, a second portion of said ball surface partially extending into said opening; and a washer member of predetermined dimensions having a receiving area and positioned in said elongated recess, said first portion of said ball surface extending partially into said washer member receiving area, the second portion of said ball surface extending into said opening whereby said washer member forces the ball detent into said detent receiving means when such first and second connector halves are mated thereby forming said mechanical interlock.

2. The system of claim 1 wherein a second ball detent is provided for interlocking the first and second connector halves of said electrical connector assembly and wherein a second detent receiving means is formed on the front portion of said first connector half, a second elongated recess of predetermined dimensions being formed in a second elongated sidewall of said second connector half, said second elongated recess dividing said second sidewall into third and fourth wall portions, an aperture being formed in said third wall portion, said aperture connecting said opening and said second elongated recess, said second ball detent being positioned in said aperture, a first portion of the surface of said second ball detent extending partially into said second elongated recess, a second portion of said second ball surface partially extending into said opening and a second washer member having an aperture and positioned in said second elongated recess, said first portion of said second ball surface extending partially into said second washer member aperture, said second portion of said ball surface extending into said opening whereby said second washer member forces said second ball detent into said detent receiving means when said first and second connector halves are mated to form said mechanical interlock.

3. The system of claim 1 wherein said washer member comprises a curved washer.

4. The system of claim 1 wherein said washer member maintains said ball detent in said receiving area aperture.

5. The system of claim 4 wherein said spring member provides a predetermined compressive force on said ball detent.

6. The system of claim 1 wherein the predetermined dimensions of said first elongated recess determines the preloaded compressive force provided by said washer member.

* * * * *